United States Patent [19]

Baker

[11] 4,437,829

[45] Mar. 20, 1984

[54] ROLL-OUT FLAME DETECTOR FOR SWIMMING POOL HEATER FUEL GAS CONTROL

[76] Inventor: Marvin E. Baker, 815 Ewing Ave., Nashville, Tenn. 37203

[21] Appl. No.: 312,403

[22] Filed: Oct. 19, 1981

[51] Int. Cl.[3] ..... F23N 5/02

[52] U.S. Cl. ..... 431/21; 431/22; 122/504

[58] Field of Search ..... 431/21, 22, 75, 78; 337/405, 404; 122/504, 504.1; 169/42

[56] References Cited

U.S. PATENT DOCUMENTS 3,275,774 9/1966 Miller ..... 337/405
3,682,251 8/1972 Livingston ..... 169/42
4,055,829 10/1977 Ruegsegger ..... 169/42
4,089,632 5/1978 Rexroad ..... 431/21

*Primary Examiner*—Samuel Scott
*Assistant Examiner*—Allen J. Flanigan
*Attorney, Agent, or Firm*—Harrington A. Lackey

[57] ABSTRACT

A roll-out flame detector mounted proximate to the lower edge of the outside of the flame wall between the combustion chamber and the control chamber of a swimming pool heater. The flame detector includes an elongated thermal fuse element exposed to potential roll-out flames and electrically connected in the electrical control for the fuel control valve to shut down the flow of fuel when the fuse element is ruptured by the roll-out flame.

6 Claims, 7 Drawing Figures

ROLL-OUT FLAME DETECTOR FOR SWIMMING POOL HEATER FUEL GAS CONTROL

BACKGROUND OF THE INVENTION

This invention relates to a safety device for a swimming pool heater, and more particularly to a roll-out flame detector for a swimming pool heater.

A swimming pool heater basically includes a combustion chamber, in the lower portion of which are mounted burner tubes. A fluid fuel, such as gas, is supplied to the burner tubes through a control valve mounted on the outside of the fire wall of the combustion chamber. In the upper portion of the combustion chamber are mounted the heat exchanger coils or tubes through which the swimming pool water flows for heating by the flame from the burner tubes. Because of the tremendous volume of water that must be heated in a swimming pool, a great number of heat exchanger coils are spaced close together to provide a maximum amount of surface area exposed to the flame. Accordingly, the close spacing of the heat exchanger coils restricts the passage of the products of combustion, and the coils become coated, and oftentimes clogged with soot from the flames. When the pool heater is inoperative, the coils collect dust from the environment, as well as rust from condensation. Moreover, the orifices in the burner tubes are likely to become clogged with soot, dirt or rust over a period of time, because of the small size of the flame orifices, and because of the same heating and environmental conditions which produce the soot, dust, and rust on the heat exchanger coils.

If either or both of the heat exchanger coils and the burner orifices are sufficiently clogged, the flow of the products of combustion from the combustion chamber will be substantially impeded, forcing the flame from the burner tubes to roll out beneath the fire wall into the control chamber, and expose the control valve not only to overheating, but to rupture, and even opening of the main gas supply pipe, thereby presenting a substantial fire and explosion hazard. Several such accidents have actually occurred resulting in substantial property damage and personal risk.

Heretofore, the only remedy for the above described hazardous situations has been in repeated inspections of the condition of swimming pool heaters, and particularly the condition of the heat exchanger tubes and the burner orifices.

The following U.S. patents disclose various types of safety devices for shutting off the flow of fuel to a burner in a heating system when an overheated condition is detected by a thermal sensing element:

U.S. Pat. No. Re.28,013, McLarty: May 24, 1974
U.S. Pat. No. 2,776,000, Miller: Jan. 1, 1957
U.S. Pat. No. 3,469,569, Brockbank: Sept. 30, 1969
U.S. Pat. No. 3,537,803, Ignazio: Nov. 3, 1970
U.S. Pat. No. 3,652,195, McIntosh et al: Mar. 28, 1972
U.S. Pat. No. 4,089,632, Rexroad: May 16, 1978.

All of the thermal sensing elements disclosed in the above patents, except the Ignazio patent, are fusible elements. Moreover, the Rexroad patent recites additional prior patents disclosing fuel controls incorporating fusible elements.

The Rexroad U.S. Pat. No. 4,089,632 discloses an elongated fusible element 30 mounted in a bracket having a non-conducting base on the exterior wall of the combustion chamber of a gas or oil burning appliance, such as a hot water heater, furnace, boiler, or stove. The fusible element is connected in series with the fuel control valve and thermocouple, so that melting of the fusible element will break the electrical control circuit and shut down the fuel control valve.

However, the above patents do not disclose a fusible roll-out flame detector specifically designed and constructed for use in connection with a swimming pool heater, much less the particular construction of the flame fuse detector per se.

SUMMARY OF THE INVENTION

It is therefore an object of this invention to provide a roll-out flame detector including an especially constructed fusible element located adjacent the lower edge of the outside of the fire wall separating the combustion chamber from the control chamber, and electrically connected to the fuel control valve for shutting down the control valve when the fusible element has been ruptured by excessive heat.

More specifically, the roll-out flame detector made in accordance with this invention includes an elongated base adapted to be mounted on the surface of the fire wall within the control chamber and extending substantially parallel along the lower edge of the fire wall. An elongated fusible element, preferably a lead wire, is connected at its opposite ends in tension to a pair of coil springs, which in turn are connected to a pair of electrodes or electrical contacts fixedly supported upon the opposite ends of the base member by insulator brackets. Each electrode is connected by a wire into the electrical control circuit for the fuel control valve so that when the fusible element melts, the gas control valve will close to shut off the fuel supply.

In order to maintain the elongated fusible wire element in tension between the coil springs, an inelastic linear member, such as a non-conducting string or cord, extends along the fusible wire element and also has its opposite ends connected to the respective coil springs. Thus, the tensile force exerted by the springs upon the fusible wire element is absorbed by the inelastic string to minimize stretching of the fusible element. Since the fusible element is maintained in tension, it is spaced from the base member, and therefore the base member may be of any rigid construction, whether conductive or non-conductive, such as plastic or metal.

The fusible element also preferably terminates at its end in enlarged heads which may be easily insertable within corresponding loop holders at the opposed ends of the coil springs for adequately suspending the fusible element in tension, and also to facilitate insertion, removal, and replacement of fusible elements between the coil springs.

DESCRIPTION OF THE PREFERRED EMBODIMENTS

Figure 1:
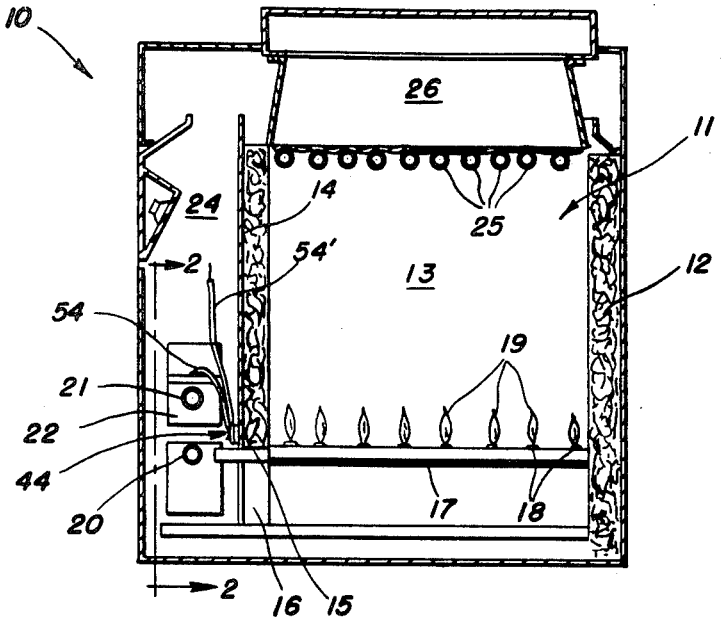
FIG. 1 is a side sectional elevation of a swimming pool heater upon which a roll-out flame detector, made in accordance with this invention, is mounted.

Referring now to the drawings in more detail, FIG. 1 discloses a typical swimming pool heater 10 including a combustion chamber 11 having insulated walls, such as the insulated rear wall 12, side walls 13 and front fire wall 14. The fire wall 14 terminates in a bottom edge 15. Below the bottom edge 15 is a primary air opening 16 through which a bank of burner tubes 17 extend rearwardly across the bottom portion of the combustion chamber 11. Each of the burner tubes 17 has a plurality of longitudinally spaced burner orifices 18 through which gas or other fluid fuel is supplied and ignited to produce the flames 19.

Figure 2:
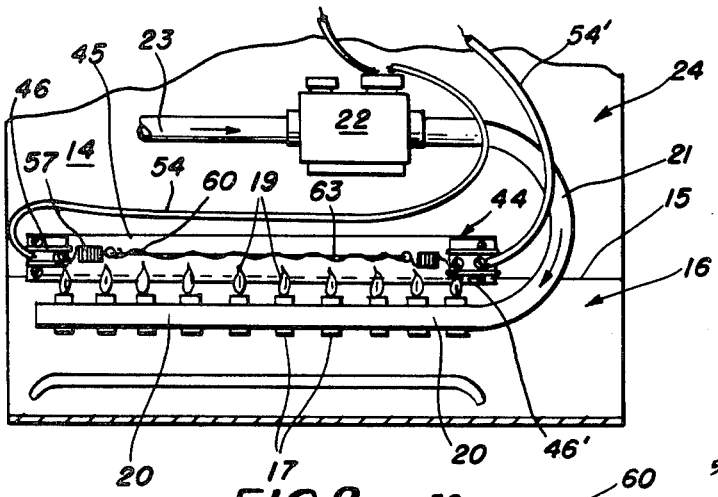
FIG. 2 is an enlarged section taken along the line 2—2 of FIG. 1.

The gas, or other fluid fuel, is supplied to the burner tubes 17 through a manifold 20, inlet pipe 21, gas valve control device 22 and gas supply pipe 23, mounted in the control chamber 24, as best disclosed in FIG. 2. Arranged in the top of the combustion chamber 11 are a plurality of heat exchanger coils or tubes 25, spaced closely together, and carrying water to the swimming pool, not shown. The air heated within the combustion chamber 11, together with the products of combustion, pass through the spaces between the heat exchanger coils 25 and upward through the exhaust duct 26 to atmosphere.

The gas valve control device 22 is a conventional device for opening and shutting off the supply of gas from the supply pipe 23 to the inlet pipe 21 in response to energization by a small electrical voltage, e.g. 750 mv., or de-energization, respectively. A conventional pilot light device 28 (FIG. 6) includes a pilot tube 29 connected through the valve control device 22 to the supply pipe 23 and a conventional thermo-electric pilot generator 30 connected through electrical leads 31 and 32 to corresponding electrodes 33 and 34 on the control device 22.

Figure 4:
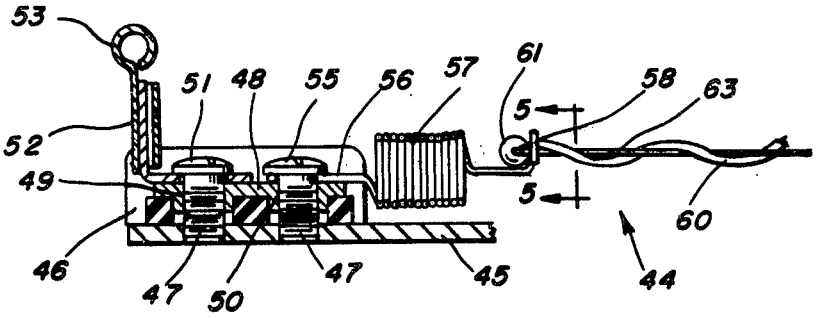
FIG. 4 is an enlarged fragmentary section taken along the line 4—4 of FIG. 3.
Figure 5:
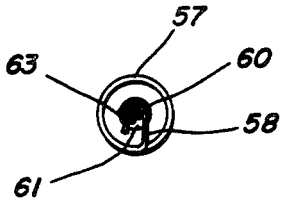
FIG. 5 is an enlarged section taken along the line 5—5 of FIG. 4.

Electrodes 35 and 36 on the control panel of the gas valve control device 22 are connected to a safety and control circuit 37, including in series a pair of high-limit safety switches 38 and 39, a pressure safety switch 40 and a thermostat 41 (FIG. 4).

Under normal operation, with the pilot generator 30 energized by the flame from the pilot light device 28, sufficient voltage is supplied through the leads 31 and 32 to the electrically controlled valve within the valve control device 22 to maintain the valve device 22 open to the flow of gas through the lines 23 and 21 and the burner tubes 17. On the other hand, when any of the high temperature switches 38 or 39, the pressure valve 40 or the thermostat 41, is actuated by the abnormal condition to which it is sensitive, the control circuit 37 is opened to cause the valve within the valve control device 22 to move to a closed position shutting off the supply of gas from the supply pipe 23 to the line 21, the manifold 20 and the burner tubes 17.

The parts thus far described are well known in the art of swimming pool heaters.

The flame detector device 44 made in accordance with this invention includes an elongated base 45 which may be made of metal or plastic or any convenient rigid material.

Fixed upon the front surface of the base 45 at each end thereof are a pair of longitudinally spaced, insulated, mounting brackets 46 and 46'. These brackets 46, 46' may be mounted upon the base 45 by any convenient means, such as the screws 47. Fixed to each of the brackets 46, 46' is an electrically conductive bridge member 48, which may be press-fitted into the insulated bracket 46. Each bridge member 48 is provided with a pair of longitudinally spaced threaded apertures 49 and 50. Secured to the threaded aperture 49 by a short screw 51 is an L-shaped electrode or electrical connector 52 having an aperture therethrough for receiving the screw 51. The electrical connector 52 has a loop 53 at the top thereof, for receiving the end of an electrical lead 54. The loop 53 may be crimped upon the end of the lead 54 to securely connect the lead 54 to the bracket 46.

Threadedly secured to the aperture 50 by a screw 55 is the looped end 56 of an electrically conductive coil spring 57. The opposite end of the coil spring 57 terminates in a wire end portion having an open loop 58, preferably U-shaped, to function as a fuse holder for an elongated thermal fuse element 60, preferably in the form of an elongated lead wire. Each end of the lead wire 60 terminates in an enlarged head or ball 61, 61' which is larger than the opening through the loop 58. Thus, when the wire 60 extends through the opening in the loop 58, the enlarged head 61 engages the wire periphery of the loop 58 to prevent further movement of the fuse element 60 away from the coil spring 57.

The bracket 46' at the opposite end of the base 45 is identical to the bracket 46, and includes all of the same elements, such as the electrical connector 52', lead 54', and coil spring 57' having the looped end 58' for holding the enlarged head or ball 61' forming the opposite extremity of the fuse wire 60. The fuse wire 60 is made of such length that when the balls 61 and 61' are engaged by their respective loop holders 58 and 58' of the coil springs 57 and 57', the fuse wire 60 will be suspended in tension between the brackets 46 and 46' and preferably spaced from the base 45.

However, since lead is a soft metal and stretches readily, a non-extensible, linear member, such as a string, or cord 63, extends along the fuse wire 60 and is also connected at its ends to the heads 61,61', in any convenient manner. The lead wire 60 may be twisted about the linear member 63, as shown in the drawings, if desired. Because of the inextensibility of the linear member 63, the linear member 63 absorbs most, if not all, of the tension exerted at its opposite ends by the coil springs 57. In this manner, the tension is relieved upon the fuse element 60, so that if the fuse element is made of soft conductive material, such as lead, the tendency to stretch will be minimized, if not eliminated.

Figure 7:
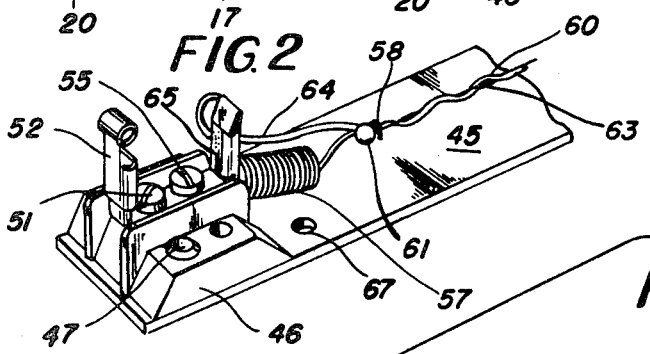
FIG. 7 is an enlarged, front perspective view of a modified flame detector, with portions broken away.
Figure 7:
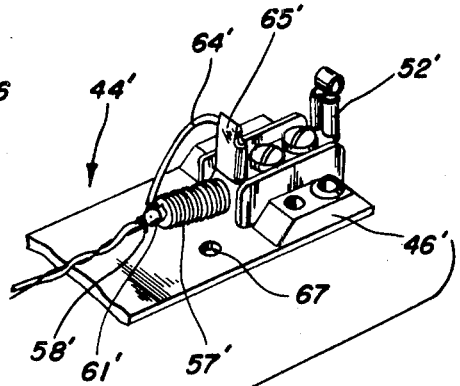
Figure 3:
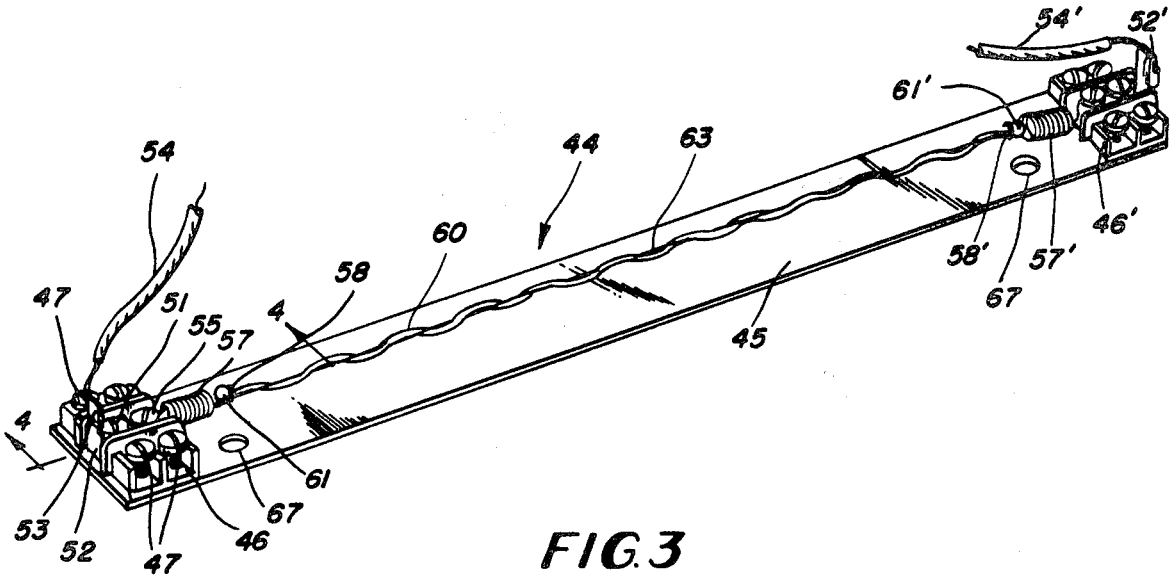
FIG. 3 is an enlarged, front perspective view of a flame detector made in accordance with this invention.

FIG. 7 discloses a slightly modified flame detector device 44' which is identical to the detector device 44, except that a conductive jumper wire 64 and 64' extends between the respective fuse heads 58 and 58' and a secondary electrical connector 65 and 65'. The purpose of these jumper wires 64 and 64' is to provide a better conductive path between the fuse wire 60 and the electrodes 52 and 52'. Occasionally, because of the relatively high electrical resistance of the materials from which the coil springs 57 and 57' are made, or because the springs 57 and 57' are covered with a shellac coating when purchased, the springs 57 and 57' have comparatively low conductivity in an electrical system in which the voltage generated by the pilot generator 30 is in the order of 750 millivolts.

The base 45 of each of the flame detector devices 44 and 44' is provided with mounting holes 67 for mounting the base 45 upon the outside of the fire wall 14 by any convenient means, such as bolts or screws. Each detector device 44 or 44' is also mounted closely adjacent the bottom edge 15 of the flame wall 14 on the outside of the flame wall 14, so that it will normally be unaffected by any combustion within the combustion chamber 11.

Figure 6:
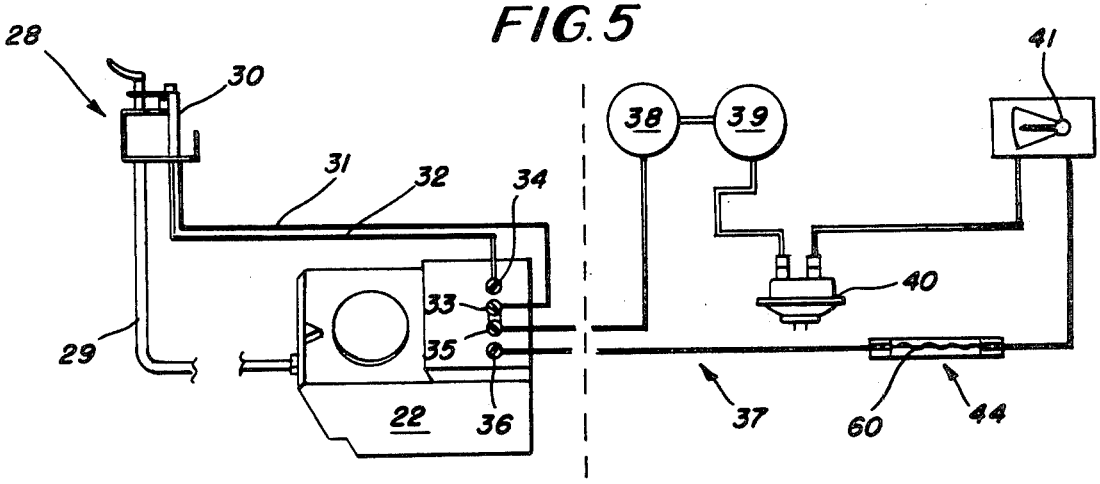
FIG. 6 is a schematic circuit diagram illustrating the flame detector device connected in the electrical control circuit.

As disclosed in FIG. 6, the flame detector device 44 is connected in series in the control circuit 37, through the opposite leads 54 and 54' (FIG. 2).

When excessive heat is developed in the combustion chamber 11, such as by blockage of the flow heated air, flame, and other products of combustion, between the heat exchanger coils 25, causing a flame roll-out through the primary air opening 16, the flame detector device 44 will immediately sense the excess heat in the control chamber 24. When the temperature of the excessive heat discharging through the opening 16 into the control chamber 24 is high enough to melt the lead fuse wire 60, the wire 60 ruptures, thereby opening the electrical control circuit 37.

Opening of the control circuit 37 will cause the valve control device 22 to close and shut down the supply of fuel from the supply pipe 23 to the inlet pipe 21. The closing of the gas supply will, of course, extinguish all flames 19 within the combustion chamber 11, and will also shut off the supply of gas through the pilot tube 29 to the pilot light device 28. This immediate elimination of the heat and flame will minimize the possibility of the automatic valve control device 22 being damaged or ruptured, as well as eliminating the possibility of the flames expanding beyond the confines of the swimming pool heater 10.

Once a fuse element 60 has ruptured, it may be easily replaced with another by slipping the heads 61 and 61' free of the open looped ends of the fuse holders 58 and 58' and reinserting the heads 58 and 58' of a new fuse element 60, for suspension between the coil springs 57 and 57'.

The various component parts mounted on each bracket 46 and 46' are relatively inexpensive and may be easily replaced by other like elements, if such become worn, broken, or distorted. If the conductive coil springs 57 and 57' loose their tensile strength or become rusted, or corroded, they may easily be replaced by other like coil springs, without replacement of any other parts. If the electrodes 52, 52' and 65 and 65' in the modified device 44' become corroded or otherwise coated with foreign material which will impede their conductive properties, they also may be easily replaced without the replacement of other parts. Likewise, individual screws 51, 55, and 47, may also be replaced if they become corroded or otherwise cease to function in their intended manner.

The depth of the screws 51 and 55 is limited so that they will not extend downward so far as to contact the base 45, particularly if the base 45 is made of a conductive metal, thereby eliminating the possibility of grounding the control circuit 37 through the respective screws 51 and 55.

The flame detector devices 44 and 44' may be easily mounted upon the fire wall 14 of any existing swimming pool heater 10 and connected into the control circuit 37 by the leads 54 and 54', with a minimum of time and effort, and with a minimum of disturbance to the existing heater elements and control circuitry.

What is claimed is:

1. In a swimming pool heater having a combustion chamber and a control chamber separated by a fire wall having a lower edge, burner tubes extending from the control chamber into the combustion chamber beneath the lower edge, a fluid fuel supply, a control valve connected in fluid communication between the fuel supply and the burner tubes and adapted to be opened and closed to the flow of fluid fuel to the burner tubes, and an electrical control circuit operably connected to the control valve for opening and closing the control valve, a flame detector device, comprising:

(a) a base, (b) a pair of electrical contacts, (c) insulated mounting means supporting said electrical contacts at longitudinally spaced positions on said base, (d) an elongated thermal fuse element having opposite ends and adapted to melt at a predetermined termperature substantially less than the temperature of the flame produced by the burner tubes, (e) suspension means holding the opposite ends of said fuse element between, and in electrical communication with, said pair of electrical contacts and spaced from said base, (f) an inextensible linear member extending along said fuse element and having opposite ends connected to said suspension means to prevent stretching of said fuse element, (g) means mounting said base on the fire wall within the control chamber so that said fuse element extends substantially along and proximate to the lower edge of the fire wall, for sensing any roll-out flame from the combustion chamber beneath the fire wall into the control chamber, and (h) means connecting said electrical contacts in said electrical control circuit so that the control valve functions normally while said fuse element is unbroken, but said control valve is closed when said fuse element ruptures.

2. The invention according to claim 1 in which said suspension means comprises a fuse holder having an opening therethrough, an enlarged head at each end of said fuse element larger than said corresponding opening, said fuse element extending through said openings so that each said head engages said corresponding fuse holder to hold said fuse element in tension.

3. The invention according to claim 2 in which each of said opposite ends of said inextensible linear member is connected to a corresponding enlarged head of said fuse element.

4. The invention according to claim 1 in which said suspension means comprises an electrically conductive coil spring connected to each end of said fuse element and to a corresponding electrical contact.

5. The invention according to claim 2 in which said fuse holder comprises an electrically conductive coil spring connected to a corresponding electrical contact, and said opening comprises an open loop of wire defining one end of each of said coil springs.

6. The invention according to claim 2 further comprising a pair of electrically conductive jumper wires, each of said jumper wires being connected in parallel across said fuse holder between a corresponding electrical contact and said fuse element.

* * * * *